US010953650B2

(12) United States Patent
Nakagawa

(10) Patent No.: US 10,953,650 B2
(45) Date of Patent: Mar. 23, 2021

(54) APPLICATOR DEVICE, APPLICATION METHOD, AND NON-TRANSITORY RECORDING MEDIUM

(71) Applicant: CASIO COMPUTER CO., LTD., Tokyo (JP)

(72) Inventor: Itaru Nakagawa, Fuchu (JP)

(73) Assignee: CASIO COMPUTER CO., LTD, Tokyo (JP)

( * ) Notice: Subject to any disclaimer, the term of this patent is extended or adjusted under 35 U.S.C. 154(b) by 0 days.

(21) Appl. No.: 16/582,970

(22) Filed: Sep. 25, 2019

(65) Prior Publication Data

US 2020/0108600 A1 Apr. 9, 2020

(30) Foreign Application Priority Data

Oct. 3, 2018 (JP) ..... JP2018-188093

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
None
See application file for complete search history.

(56) References Cited

U.S. PATENT DOCUMENTS

2013/0257956 A1* 10/2013 de Jong ..... B41J 25/304 347/16

FOREIGN PATENT DOCUMENTS

| | | | |
|---|---|---|---|
| JP | H04-093276 | A | 3/1992 |
| JP | H10-035034 | A | 2/1998 |
| JP | 2007-245421 | A | 9/2007 |
| JP | 2018-122517 | A | 8/2018 |

* cited by examiner

*Primary Examiner* — Erica S Lin
(74) *Attorney, Agent, or Firm* — Fitch, Even, Tabin & Flannery LLP

(57) ABSTRACT

An applicator device includes a print head that applies droplets to a target, and a processor. The processor is configured to acquire a value relating to a contact of the applicator device against the target, detect movement of the applicator device on the target, and control, when the value is within a set range, the print head to apply droplets on the target based on the detected movement.

11 Claims, 9 Drawing Sheets

APPLICATOR DEVICE, APPLICATION METHOD, AND NON-TRANSITORY RECORDING MEDIUM

CROSS-REFERENCE TO RELATED APPLICATION

This application is based upon and claims the benefit of priority under 35 USC 119 of Japanese Patent Application No. 2018-188093 filed on Oct. 3, 2018, the entire disclosure of which, including the description, claims, drawings, and abstract, is incorporated herein by reference in its entirety.

FIELD

This application relates generally to an applicator device, an application method, and a non-transitory recording medium.

BACKGROUND

In the related art, there are devices that apply a droplet to an application surface of an application medium based on movement of the device on the application surface of the application medium. For example, Unexamined Japanese Patent Application Kokai Publication No. H10-35034 describes a manual printing device that prints on a recording medium by being manually scanned on the recording medium. Specifically, the printing device described in Unexamined Japanese Patent Application Kokai Publication No. H10-35034 prints by spraying, in accordance with the amount of movement of the device, ink from a print head onto the recording medium when the device is manually scanned on the recording medium by a user.

SUMMARY

According to one aspect of the present disclosure, an applicator device includes a print head that applies a droplet to a target, and a processor. The processor is configured to acquire a value relating to a contact of the applicator device against the target, detect movement of the applicator device on the target, and control, when the value is within a set range, the print head to apply the droplet on the target based on the detected movement.

According to another aspect of the present disclosure, an application method for applying a droplet using an applicator device includes acquiring a value relating to a contact of the applicator device against a target, detecting movement of the applicator device on the target, and applying the droplet on the target based on the detected movement when the acquired value is within a set range.

According to yet another aspect of the present disclosure, a non-transitory computer-readable recording medium stores a program. The program causes a computer of an applicator device to execute processing for acquiring a value relating to a contact of the applicator device against a target, detecting movement of the applicator device on the target, and applying a droplet on the target based on the detected movement when the acquired value is within a set range.

BRIEF DESCRIPTION OF THE DRAWINGS

A more complete understanding of this application can be obtained when the following detailed description is considered in conjunction with the following drawings, in which.

DETAILED DESCRIPTION

Figure 1:
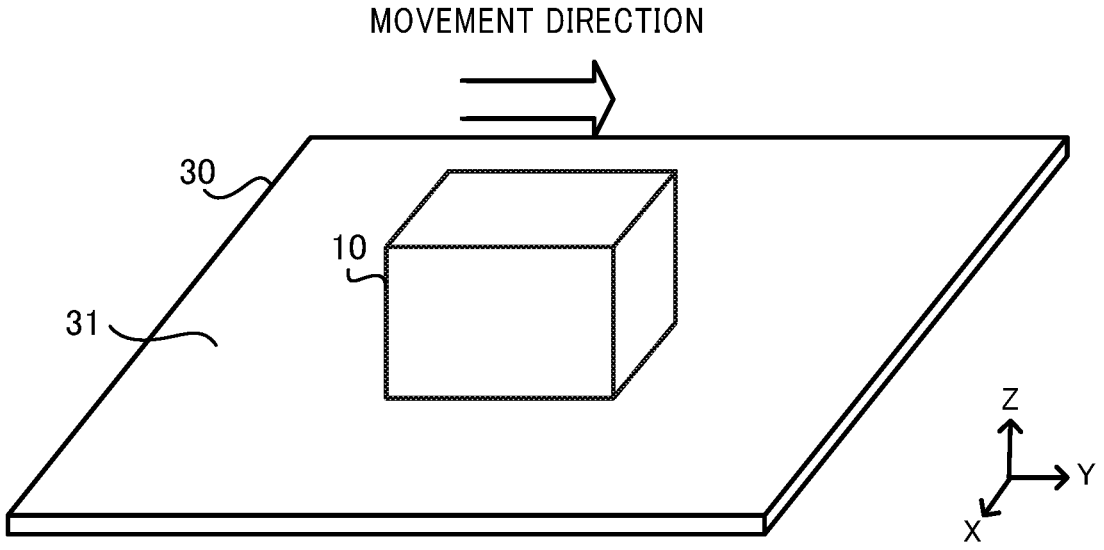
FIG. 1 is a drawing illustrating an overview of an applicator device according to Embodiment 1 of the present disclosure.

Hereinafter, embodiments of the present disclosure are described while referencing the drawings. Note that, in the drawings, identical or corresponding components are marked with the same reference numerals.

Embodiment 1

FIG. 1 illustrates an applicator device 10 according to Embodiment 1 of the present disclosure. The applicator device 10 is a device which, by applying ink (droplet) on an application target 30 in accordance with the movement of the applicator device 10, is capable of printing an image to be printed on the application target 30. Examples of the image to be printed include characters, symbols, shapes, designs, patterns, and the like.

The application target 30 is an object to which ink is to be applied by the applicator device 10. For example, the application target 30 is printing paper, a label, cardboard, or the like. However, the application target 30 is not limited to objects made from paper and may be made from plastic, metal, wood, or the like. That is, the application target 30 may be made from any material, provided that ink can adhere to the material. In the following, an example is given in which the application target 30 is formed from a material that has elasticity. Here, the material that has elasticity is defined as a material that deforms when pressure is applied to the surface thereof. Examples of the material that has elasticity include human skin, animal skin, and the like, rubber such as tires and tubes, and textiles such as fabric and leather.

The surface of the application target 30 on which ink is to be applied, namely an application surface 31, is not limited to a flat surface, and may be a curved surface or an undulating surface. The ink is a material (paint) that is to be applied to the application target 30 in order to print the image to be printed. Note that the ink is not limited to being a liquid, and may be a solid or a gel. The ink may be a dye ink, a pigment ink, or the like and, provided that the ink can be applied, may be made from any material.

As illustrated in FIG. 1, an image to be printed is formed on the application target 30 by a user gripping the applicator device 10 by hand, and applying ink while sliding/moving, in a predetermined movement direction, the applicator device 10 on the application target 30. Such an applicator device 10 that utilizes such a system is also referred to as a manual scanning-type printing device, a handy printer, a direct printer, and the like.

In FIG. 1, the X-direction corresponds to the main scanning direction (width direction) of the applicator device 10, the Y-direction corresponds to the sub scanning direction (movement direction) of the applicator device 10, and the Z-direction corresponds to the direction perpendicular to the application surface 31 of the application target 30, that is, corresponds to the vertical direction. The X-direction, the Y-direction, and the Z-direction are orthogonal to each other. These definitions apply to the other drawings as well.

Figure 2:
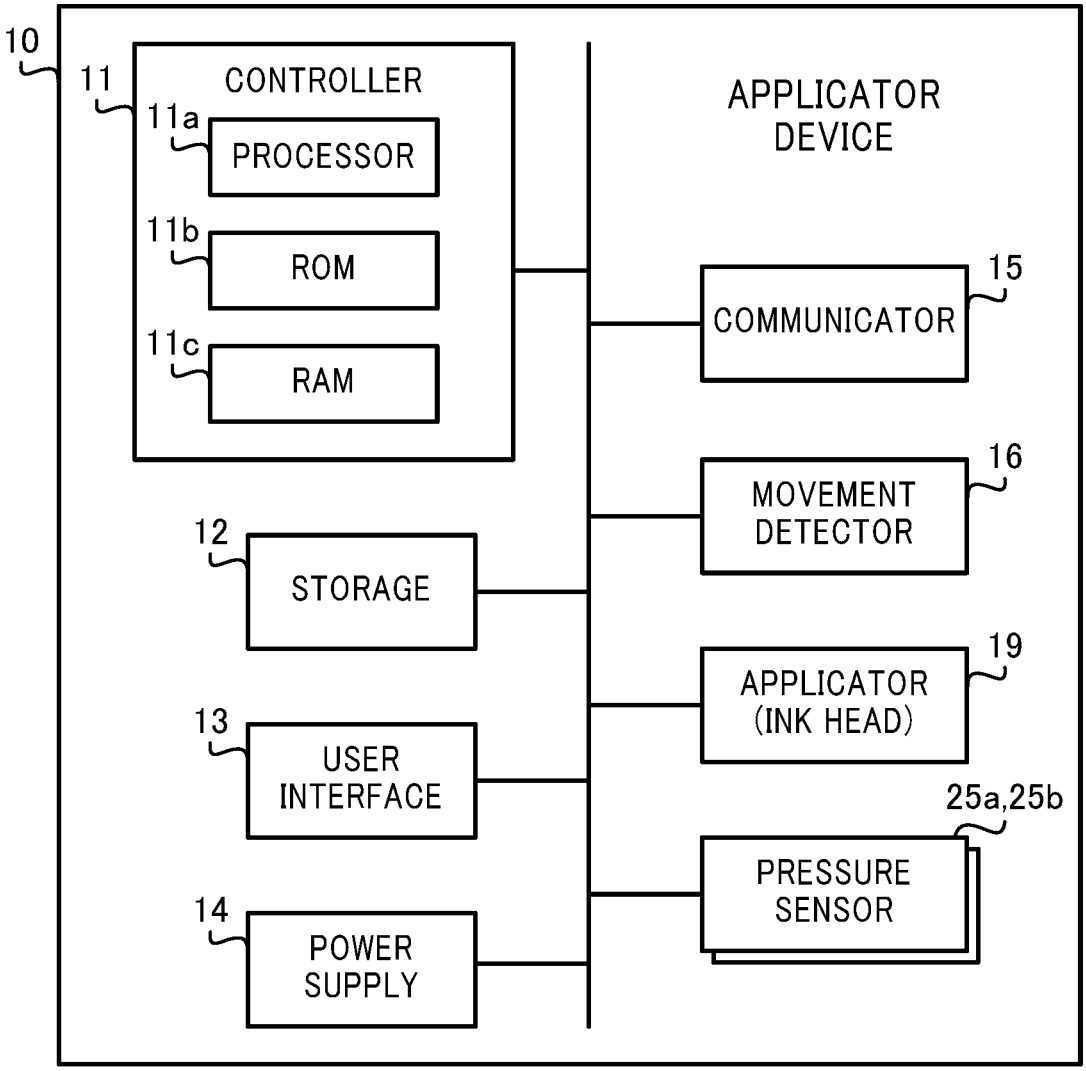
FIG. 2 is a block diagram illustrating the hardware configuration of the applicator device according to Embodiment 1.

As illustrated in FIG. 2, the applicator device 10 includes a controller 11, a storage 12, a user interface 13, a power supply 14, a communicator 15, a movement detector 16, an ink head (print head, applicator) 19, and pressure sensors 25*a* and 25*b*.

The controller 11 includes a processor (central processing unit (CPU)) 11*a*, read only memory (ROM) 11*b*, and random access memory (RAM) 11*c*. In one example, the processor 11*a* is a microprocessor or the like and is a central processing unit that executes various processes and computations. In the controller 11, the processor 11*a* is connected, via a system bus, to each component of the applicator device 10. Additionally, the processor 11*a* functions as control means that reads out a control program stored in the ROM 11*b* and controls the operations of the entire applicator device 10 while using the RAM 11*c* as working memory. The controller 11 also includes a timer that measures time, such as a real time clock (RTC).

The storage 12 is nonvolatile memory such as flash memory or a hard disk. The storage 12 stores programs and data used by the controller 11 to perform various processes. For example, the storage 12 stores display data and printing data for displaying and printing characters, symbols, emoji, and the like, and also stores tables that define the various settings of the printing. Moreover, the storage 12 stores data generated or acquired as a result of the controller 11 performing the various processes.

The user interface 13 includes an input receiver such as an input key, a button, a switch, a touch pad, or a touch panel; a display device such as a liquid crystal panel and a light emitting diode (LED); and a speech outputter such as a speaker. The user interface 13 receives various operation commands from the user via the input receiver, and sends the received operation commands to the controller 11. Moreover, the user interface 13 acquires various information from the controller 11 and displays images that represent the acquired information on the display device. Alternatively, the user interface 13 outputs speech that represents the acquired information.

The power supply 14 includes a battery and a voltage detector, produces the power necessary for the operations of the applicator device 10, and supplies that power to the various components.

The communicator 15 includes an interface that enables the applicator device 10 to communicate with external devices. Examples of the external devices include personal computers, tablet terminals, smartphones, and other terminal devices. The communicator 15 communicates with the external devices via, for example, a universal serial bus (USB), a wireless local area network (LAN) such as wireless fidelity (Wi-Fi), Bluetooth (registered trademark), or the like. Under the control of the controller 11, the communicator 15 acquires, via such wired or wireless communication, various types of data, including print data, from the external devices.

The movement detector 16 is provided on the lower portion of the applicator device 10 and, when the applicator device 10 is moved on the application target 30, detects the movement of the applicator device 10. Specifically, the movement detector 16 includes a LED or similar light emitter that emits light toward the surface of the application target 30, and an optical sensor that reads the light that is emitted from the light emitter and that reflects at the surface of the application target 30. The movement detector 16 uses the optical sensor to read the light emitted from the LED, and detects the amount of movement and the direction of movement of the applicator device 10 based on changes in the light that is read. The movement detector 16 functions as movement detection means.

The applicator (ink head) 19 is an application mechanism (printing mechanism) that prints by applying ink to the surface of the application target 30. The applicator 19 uses an ink jet method to apply the ink to the surface of the application target 30. In this method, an ink tank is filled with ink and this ink is micronized and directly sprayed onto the application target 30. The applicator 19 functions as applicator means.

In one example, the applicator 19 discharges ink by a thermal method. Specifically, a plurality of nozzles is disposed on the applicator 19. The plurality of nozzles is arranged in the main scanning direction (X-direction) and the sub scanning direction (Y-direction). The ink in the pluralities of nozzles is heated by a heater to produce air bubbles and the ink is discharged, by the air bubbles, from each of the plurality of nozzles toward (vertically downward) the application target 30. The applicator 19 applies ink to the surface of the application target 30 according to this principle.

Each of the pressure sensors 25*a* and 25*b* is a sensor that measures pressure by a known method such as by capacitance, by a strain gauge type, or the like. When the applicator device 10 is placed on the application target 30, each of the pressure sensors 25*a* and 25*b* detects the magnitude of the pressure applied to the application surface 31 by the applicator device 10, and coverts the detected magnitude of the pressure to an electronic signal. Thus, each of the pressure sensors 25*a* and 25*b* measures the pressure applied to the application target 30 by the applicator device 10. Each of the pressure sensors 25*a* and 25*b* functions as first measuring means that measures an index value that represents the strength of contact of the applicator device 10 against the application target 30. In one example, the index value is a physical quantity measured in terms of Newtons.

Figure 3:
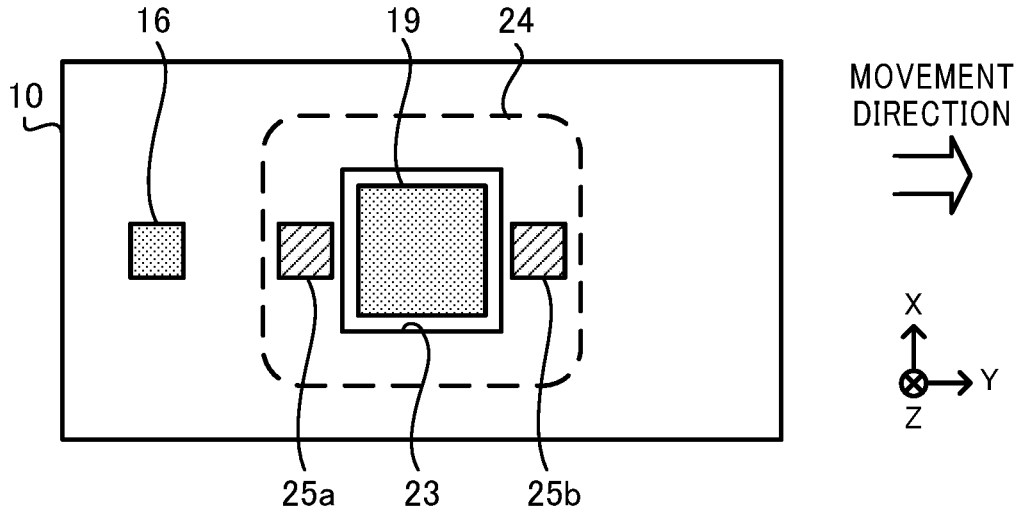
FIG. 3 is a drawing schematically illustrating the bottom surface of the applicator device according to Embodiment 1.
Figure 4:
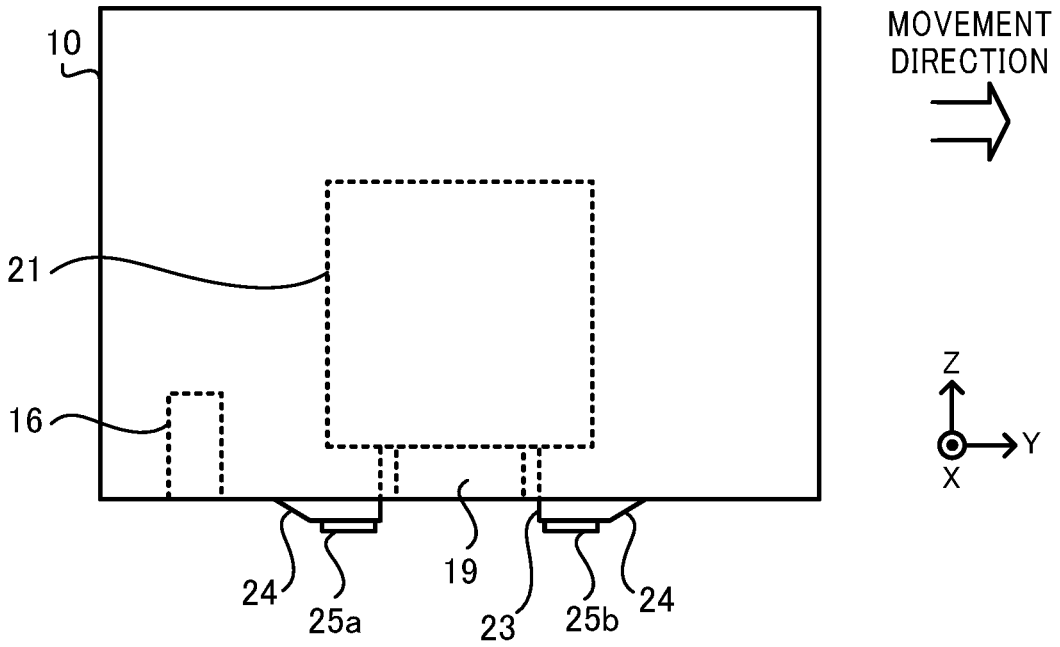
FIG. 4 is a drawing illustrating the applicator device according to Embodiment 1, as seen from the side.

FIG. 3 illustrates the bottom surface of the applicator device 10, that is, the surface of the applicator device 10 that faces the application target 30. FIG. 4 illustrates a situation, as seen from the side, in which the applicator device 10 moves on the application target 30. In FIG. 4, the positions in the applicator device 10 where the optical sensor of the movement detector 16, the nozzles of the applicator 19, and the ink tank 21 are provided are indicated by dashed lines. As illustrated in FIGS. 3 and 4, the optical sensor of the movement detector 16 and the nozzles of the applicator 19 are provided facing the lower side of the applicator 19. As a result of this configuration, the optical sensor of the movement detector 16 and the nozzles of the applicator 19 face the application surface 31 of the application target 30 on which the applicator device 10 is being scanned.

As illustrated in FIGS. 3 and 4, an application opening 23 for the ink of the applicator 19 is provided in the bottom surface of the applicator device 10, at a position directly below the applicator 19. The application opening 23 is an opening that is provided in the housing (case) of the applicator device 10. Due to the application opening 23, the nozzles of the applicator 19 are exposed through the bottom surface of the applicator device 10, thereby making it possible for the ink to be applied to the application target 30. The applicator device 10 applies, through the application opening 23, the ink from the applicator 19 when the applicator device 10 is scanned on the application target 30.

The first pressure sensor 25*a* and the second pressure sensor 25*b* are provided on the periphery of the application opening 23 at positions symmetrical around the application opening 23. That is, the first pressure sensor 25*a* and the second pressure sensor 25*b* are provided at positions opposite each other across the application opening 23. The pressure applied near the application opening 23 can be accurately measured due to the two pressure sensors 25*a* and 25*b* being provided on the periphery of the application opening 23. Furthermore, since the two pressure sensors 25*a* and 25*b* are provided at positions opposite each other across the application opening 23, the pressure sensors 25*a* and 25*b* can, for example, detect when the applicator device 10 is placed in a tilted manner against the application surface 31. As a result of this configuration, it is possible to detect whether the applicator device 10 is correctly placed on the application surface 31.

Furthermore, a protrusion 24 is provided around the application opening 23 in the portion depicted by the dashed lines in FIG. 3. The protrusion 24 protrudes from the bottom surface of the applicator device 10 and the two pressure sensors 25*a* and 25*b* are provided on the protrusion 24. When the user places the bottom surface of the applicator device 10 on the application target 30, the protrusion 24 contacts the application surface 31 before the other portions of the bottom surface of the applicator device 10 contact the application surface 31. Since the pressure sensors 25*a* and 25*b* are provided on the protrusion 24, the pressure sensors 25*a* and 25*b* can accurately measure the pressure that the applicator device 10 applies to the application target 30 when the applicator device 10 is placed on the application target 30.

As illustrated in FIG. 4, the protrusion 24 has an inclined surface on an outside of portions on which the two pressure sensors 25*a* and 25*b* are provided, so as to avoid occurrence of a step height between the surface of the protrusion 24 and the bottom surface of the applicator device 10. The inclined surface thus provided outside the protrusion 24 provides smooth connection of the surface of the protrusion 24 to the bottom surface of the applicator device 10, thereby enabling a user to more easily move the applicator device 10, with the bottom surface of the applicator device 10 in contact with the application surface 31. That is, for example, compared with a case in which the protrusion 24 has an outer side portion that extends substantially perpendicularly to the bottom surface of the applicator device 10, providing in the protrusion 24 the inclined surface as illustrated in FIG. 4 can prevent the protrusion 24 from being caught on the application surface 31, thereby enabling a user to more easily move the applicator device 10, with the bottom surface of the applicator device 10 in contact with the applicator surface 31.

Figure 5:
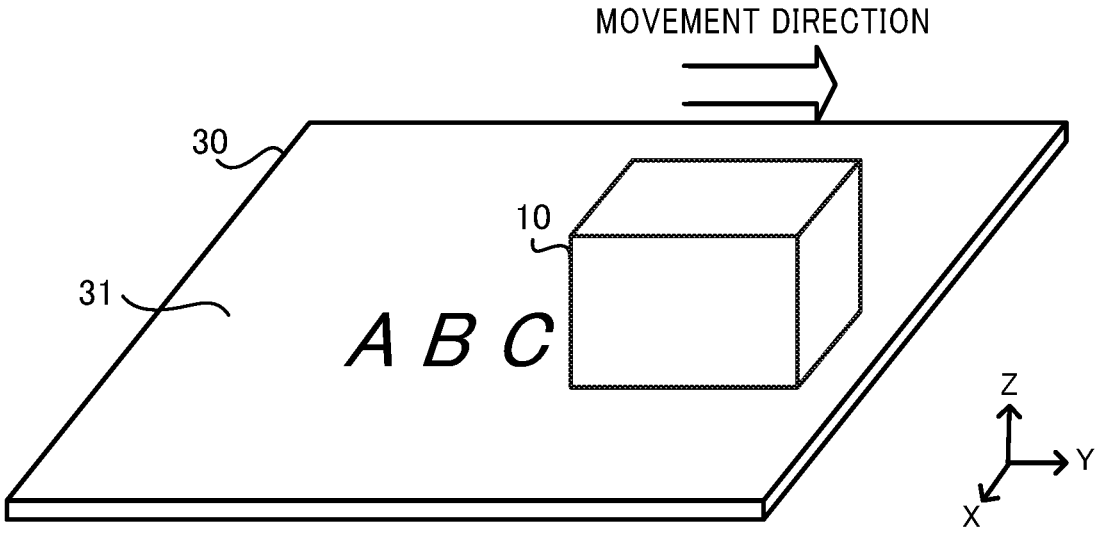
FIG. 5 is a drawing illustrating an example of the applicator device according to Embodiment 1 applying ink.

FIG. 5 illustrates a situation in which the applicator device 10 applies ink to the application surface 31 of the application target 30. In cases in which ink is to be applied to the application target 30, the user arranges the applicator device 10 on the application surface 31 such that the bottom surface of the applicator device 10 faces the application surface 31, as illustrated in FIG. 5. While in this arrangement, when the user scans the applicator device 10 so as to traverse the application surface 31, the applicator 19 applies ink to the application surface 31. As a result, a string of characters such as, for example "ABC" as illustrated in FIG. 5, is printed as a print image.

Figure 6:
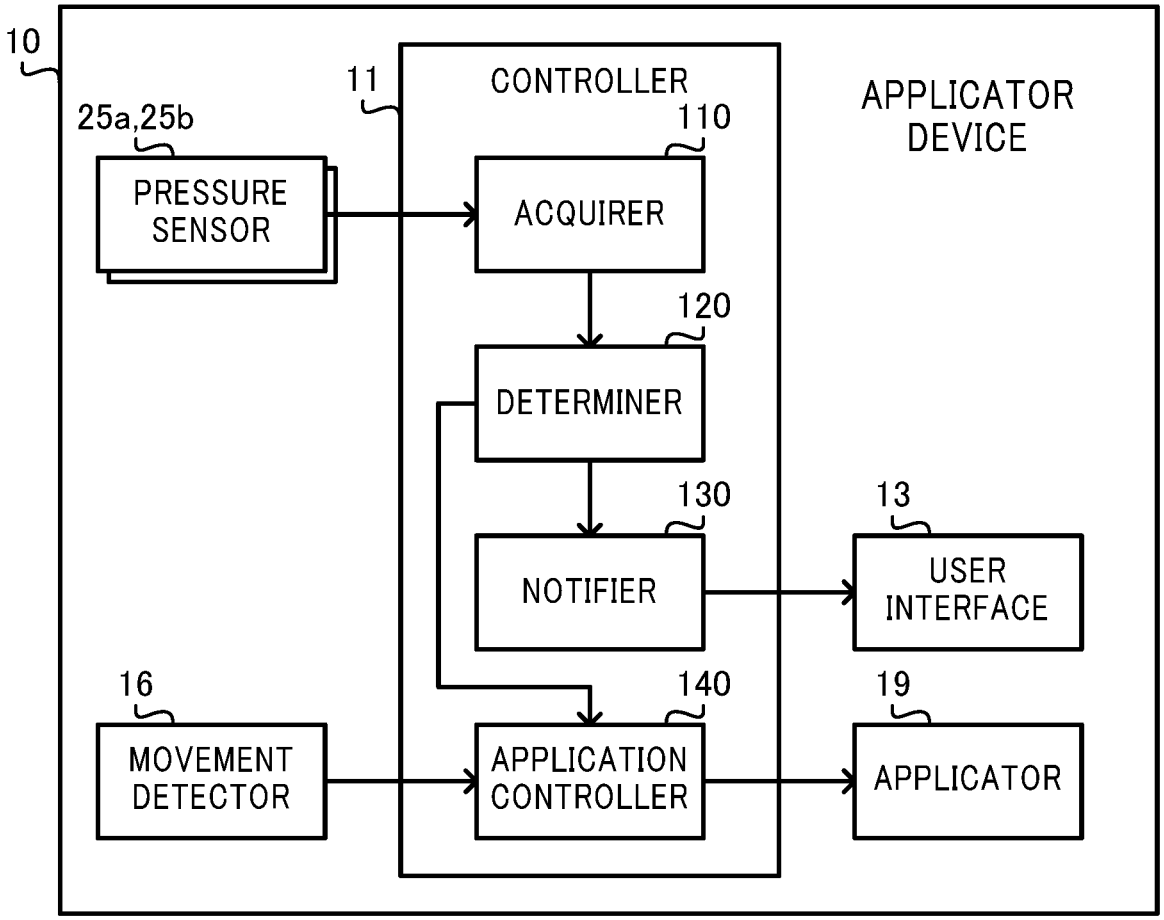
FIG. 6 is a block diagram illustrating the functional configuration of the applicator device according to Embodiment 1.

Next, the functional configuration of the controller 11 of the applicator device 10 is described while referencing FIG. 6. As illustrated in FIG. 6, the applicator device 10 includes, as functional components, an acquirer 110, a determiner 120, a notifier 130, and an application controller 140. The processor 11*a* reads the program stored in the ROM 11*b* out to the RAM 11*c* and executes that program. As a result, the controller 11 functions as the various components described above.

The acquirer 110 acquires index values that represent the strength of contact of the applicator device 10 against the application target 30. Here, "the strength of contact of the applicator device 10 against the application target 30" means the magnitude of the force with which the applicator device 10 is pressed against the application surface 31 when the user has set the applicator device 10 on the application surface 31.

The acquirer 110 acquires, as the index values that represent the strength of contact, a value of a first pressure measured by the first pressure sensor 25*a*, and a value of a second pressure measured by the second pressure sensor 25*b*. The values of the pressure measured by the two pressure sensors 25*a* and 25*b* are respectively zero when the applicator device 10 is not in contact with the application target 30, and increase as the strength of contact increases. The acquirer 110 is realized by cooperation between the controller 11 and the pressure sensors 25*a* and 25*b*. The acquirer 110 functions as acquisition means.

The determiner 120 determines whether the index values acquired by the acquirer 110 are within a predetermined range (set range). The predetermined range is an allowable range wherein the applicator device 10 is capable of correctly applying the ink to the application target 30. Specifically, the predetermined range is a range that is less than or equal to a predetermined maximum value TH and greater than or equal to a predetermined minimum value TL. Here, the maximum value TH is a first threshold that constitutes the allowable upper limit at which the applicator device 10 can normally apply the ink. The minimum value TL is a value that is less than the maximum value TH and is a second threshold that constitutes the allowable lower limit at which the applicator device 10 can normally apply the ink. Note that the predetermined range is determined based on various factors such as the weight of the applicator device 10, the positions where the pressure sensors are installed on the applicator device 10, and the like. As such, the predetermined range is set at the design stage or prior to use.

Figure 7:
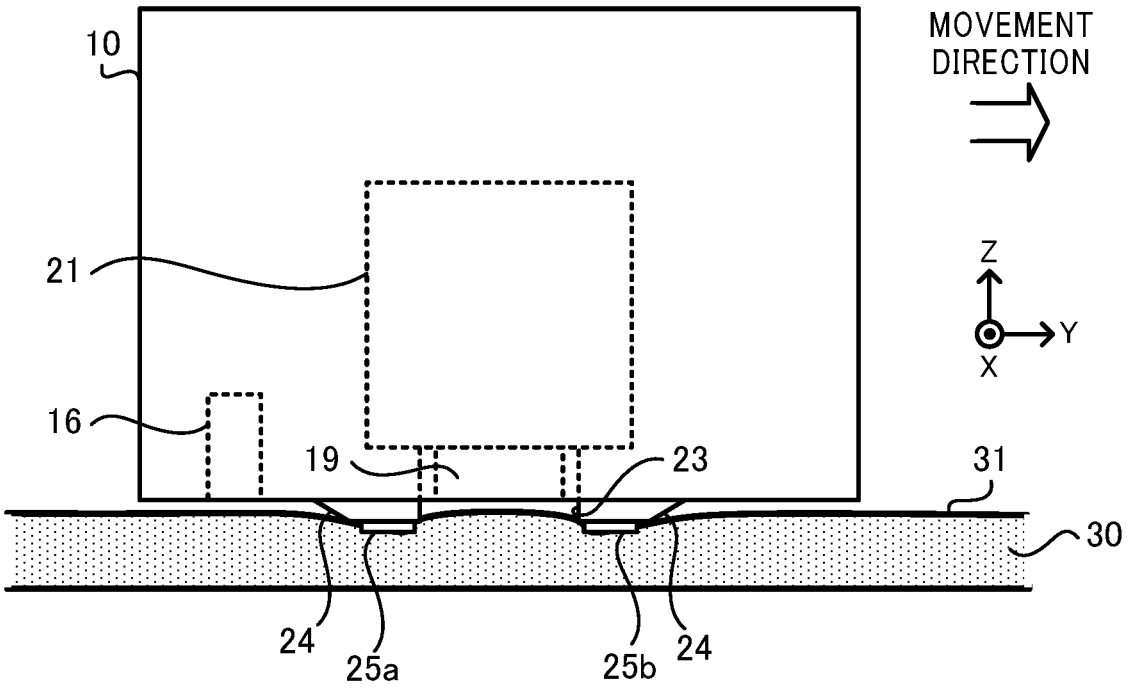
FIG. 7 is a drawing illustrating an example of Embodiment 1, and depicts the applicator device and an application target in a case in which pressure measured by a pressure sensor is greater than a maximum value.

When the values of the pressure measured by the pressure sensors 25*a* and 25*b* are greater than the maximum value TH, the pressure applied to the application surface 31 by the applicator device 10 is excessively strong. In such a case, as illustrated in FIG. 7, the applicator device 10 is strongly pressed against the application surface 31 and, as a result, the protrusion 24 sinks into the elastic application surface 31. While in this state, not only is it impossible to smoothly scan the applicator device 10 on the application surface 31, but the tips of the nozzles of the applicator 19 may be excessively close to the application surface 31 and may contact the application surface 31.

Figure 8:
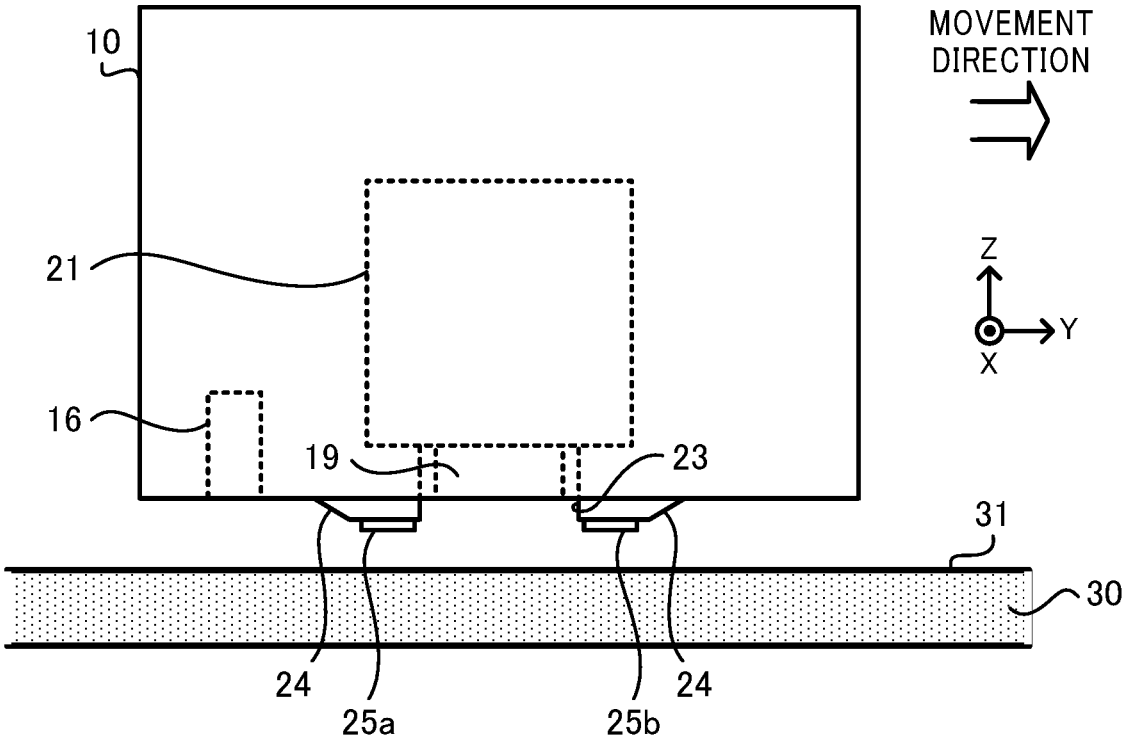
FIG. 8 is a drawing illustrating an example of Embodiment 1, and depicts the applicator device and an application target in a case in which the pressure measured by the pressure sensor is less than a minimum value.

In contrast, when the values of the pressure measured by the pressure sensors 25*a* and 25*b* are less than the minimum value TL, the pressure applied to the application surface 31 by the applicator device 10 is excessively weak. In this case, the applicator device 10 does not correctly contact the application surface 31 and, as illustrated in FIG. 8, the protrusion 24 is separated from the application surface 31. In such a state, the movement detector 16 cannot appropriately detect the movement of the applicator device 10 on the application surface 31. Additionally, even if movement can be detected, it is difficult to apply the ink on the application surface 31 at accurate positions.

Figure 9:
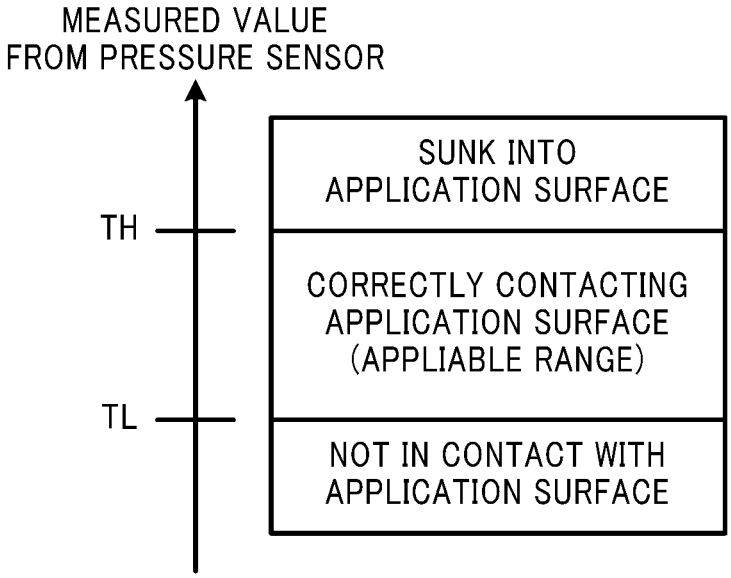
FIG. 9 is a drawing illustrating determination criteria for the measured values of the pressure, determined by a determiner.

Therefore, as illustrated in FIG. 9, when the measured values of the pressure applied to the application surface 31 by the applicator device 10 are greater than the maximum value TH, the determiner 120 determines that the applicator device 10 is sunk into the application surface 31 and, as such, application is not possible. Moreover, when the measured values of the pressure are less than the minimum value TL, the determiner 120 determines that the applicator device 10 is not correctly contacting the application surface 31 and, as such, application is not possible. Meanwhile, when the measured values of the pressure are in the range less than or equal to the maximum value TH and greater than or equal to the minimum value TL, the determiner 120 determines that the ink can be appropriately applied.

Thus, the determiner 120 determines whether each of the values of pressure measured by the two pressure sensors 25*a* and 25*b* as the index values acquired by the acquirer 110 are within the predetermined range. As a result, the determiner 120 determines whether the applicator device 10 can appropriately apply the ink. The determiner 120 is realized by cooperation between the controller 11 and the storage 12. The determiner 120 functions as determination means.

The notifier 130 issues an alert when the index values acquired by the acquirer 110 are not within the predetermined range. Specifically, when the value of the first pressure measured by the first pressure sensor 25*a* and/or the value of the second pressure measured by the second pressure sensor 25*b* is greater than the maximum value TH, the notifier 130 outputs, via the display device or the speaker of the user interface 13, a message such as "The device is applying too much pressure. Please apply less pressure." Moreover, when the value of the first pressure measured by the first pressure sensor 25*a* and/or the value of the second pressure measured by the second pressure sensor 25*b* is less than the minimum value TL, the notifier 130 outputs, via the display device or the speaker of the user interface 13, a message such as "The pressure of the device is insufficient. Please apply more pressure."

By outputting such an alert message via the user interface 13, the notifier 130 informs the user that the ink cannot be appropriately applied to the application target 30 if the applicator device 10 is scanned as-is. The notifier 130 is realized by cooperation between the controller 11 and the display device of the user interface 13. The notifier 130 functions as notification means.

The application controller 140 controls the application of the ink by the applicator 19. The applicator 19 applies the ink to the application surface 31 under the control of the application controller 140. Specifically, when the movement detector 16 detects movement of the applicator device 10 on the application target 30, the application controller 140 causes the applicator 19 to apply, based on the detected movement, the ink in accordance with specified application data.

The application data is data that includes image data that represents an image to be drawn on the application target 30, and information such as the size of the image data. The application data is generated as a result of an operation command received from the user. The operation command is received via a printer driver that is preinstalled on a personal computer, a tablet terminal, a smartphone, or other terminal device. The application controller 140 acquires, via the communicator 15, this generated printing data from the terminal device. Alternatively, the application data may be created as a result of the user inputting a command via the input receiver of the user interface 13. Moreover, the application data may be stored in advance in the storage 12.

The application controller 140 outputs the content of the acquired application data to the applicator 19 each time the movement detector 16 detects a predetermined amount of movement, thereby causing an image of a length that corresponds to the detected amount of movement to be printed. Then, the application controller 140 controls the energizing dots of the applicator 19 and causes the ink to be discharged from the nozzles of the applicator 19. Thus, printing is performed. The application controller 140 is realized by cooperation between the controller 11 and the applicator 19. The application controller 140 functions as application control means.

Specifically, the application controller 140 controls the application of the ink by the applicator 19 in accordance with the determination results from the determiner 120 of the measured values of the pressure. It is expected that the applicator device 10 is correctly placed on the application surface 31 when the determiner 120 determines that both the value of the first pressure measured by the first pressure sensor 25*a* and the value of the second pressure measured by the second pressure sensor 25*b* are within the predetermined range. Since, in this case, the applicator device 10 is assumed to be correctly placed on the application surface 31, the application controller 140 causes the applicator 19 to apply the ink based on the movement of the applicator device 10 detected by the movement detector 16. As a result, printing according to the specified application data is performed, and a string of characters such as, for example "ABC" as illustrated in FIG. 5, is printed on the application target 30.

In contrast, it is expected that, as illustrated in FIG. 7 or 8, the contact of the applicator device 10 against the application surface 31 is excessively strong or weak when the determiner 120 determines that the value of the first pressure measured by the first pressure sensor 25*a* and/or the value of the second pressure measured by the second pressure sensor 25*b* is not within the predetermined range. In other words, in such a case, there is a high possibility that the applicator device 10 is not correctly placed on the application surface 31. In such a case, it is determined that, even if the applicator device 10 is scanned on the application surface 31, printing cannot be performed appropriately. As such, the application controller 140 does not cause the applicator 19 to apply the ink even if the movement detector 16 detects movement of the applicator device 10.

Thus, the application controller 140 only causes the applicator 19 to apply the ink based on the movement of the applicator device 10 when both the measured values of the pressure from the two pressure sensors 25*a* and 25*b* are within the predetermined range. Due to this configuration, application of the ink while the applicator device 10 is not appropriately contacting the application target 30 can be prevented and, as a result, applying and printing mistakes can be suppressed.

Figure 10:
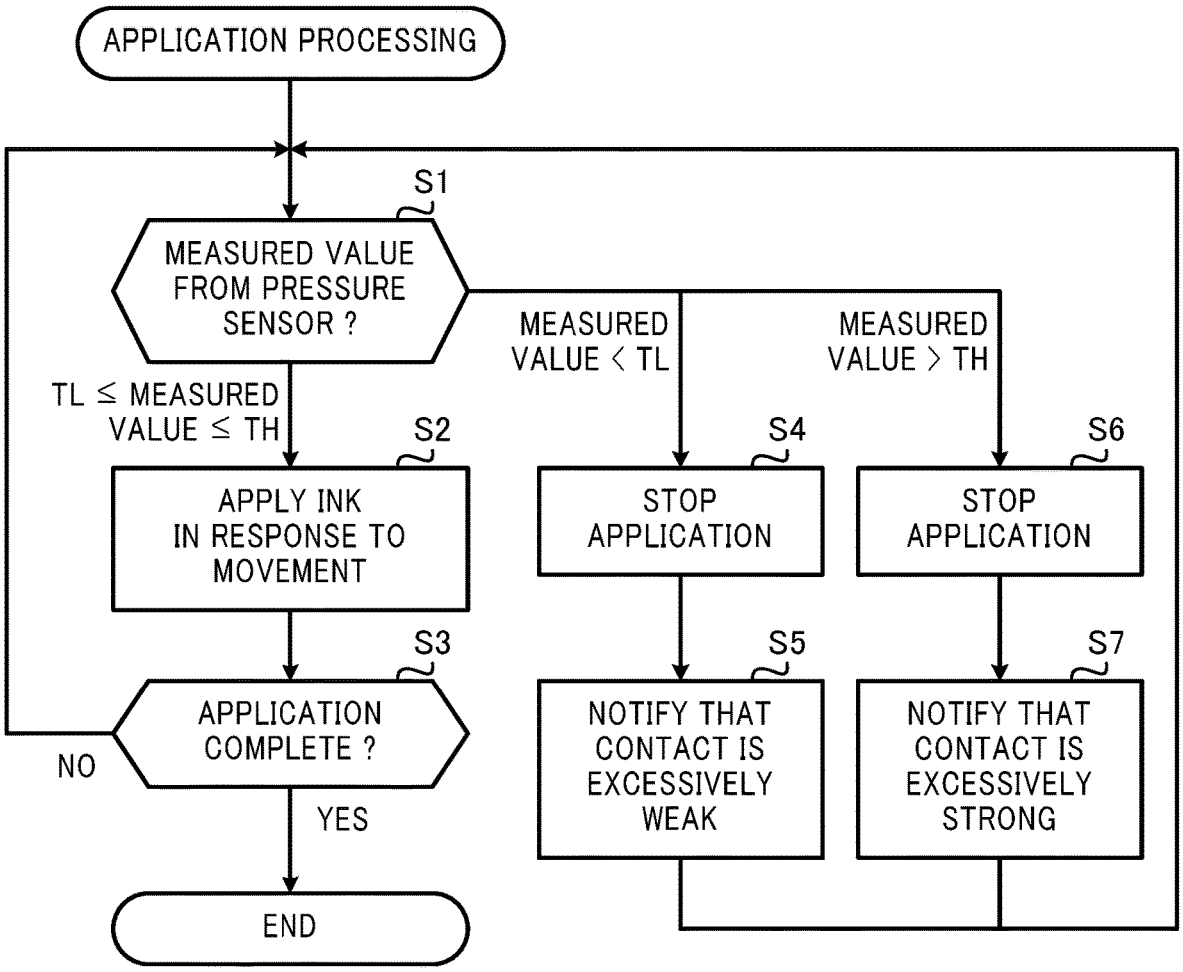
FIG. 10 is a flowchart illustrating the flow of application processing executed by the applicator device according to Embodiment 1.

Next, the flow of the processing executed in the applicator device 10 configured as described above is described while referencing FIG. 10.

In cases in which a user desires to apply ink to the application surface 31 of the application target 30, the user operates the user interface 13 to specify the desired application data. Then, the user places the applicator device 10 on the application surface 31 such that the bottom surface of the applicator device 10 faces the application surface 31. When the print start button is pressed in this state, the application processing illustrated in FIG. 10 starts.

When the application processing starts, the controller 11 determines the measured values of the pressure from the two pressure sensors 25*a* and 25*b* (step S1). Specifically, the controller 11 functions as the acquirer 110 and acquires the values of the pressure measured by the two pressure sensors 25*a* and 25*b*.

Then, the controller 11 functions as the determiner 120 and compares each of the acquired values of the pressure with the maximum value TH and the minimum value TL. As a result of this comparison, the controller 11 determines whether the measured values of the pressure are within the predetermined range.

When the measured values of the pressure from the two pressure sensors 25*a* and 25*b* are both greater than or equal to the minimum value TL and less than or equal to the maximum value TH (step S1; TL≤measured value≤TH), the controller 11 functions as the application controller 140 and applies the ink in response to the movement of the applicator device 10 on the application target 30 (step S2). Specifically, the controller 11 determines whether movement of the applicator device 10 on the application target 30 is detected by the movement detector 16. Then, if movement is detected, the controller 11 causes the applicator 19 to apply, in accordance with the detected movement, the ink in a pattern that corresponds to the specified application data. As a result, the controller 11 prints a string of characters such as, for example, "ABC" as illustrated in FIG. 5, on the application surface 31.

When applying the ink in response to the movement of the applicator device 10, the controller 11 determines whether the application of the ink in accordance with the specified application data is completed (step S3). If the application of the ink is not completed (step S3; NO), the controller 11 returns to the processing of step S1. Then, the controller 11 determines again whether the measured values of the pressure from the two pressure sensors 25*a* and 25*b* are within the predetermined range.

In step S1, in cases in which at least one of the measured values of the pressure from the two pressure sensors 25*a* and 25*b* is less than the minimum value TL (step S1; measured value<TL), there is a high possibility that the applicator device 10 is insufficiently contacting the application surface 31 and that the applicator device 10 is separated from the application surface 31. As such, in this case, the controller 11 stops the application of the ink (step S4). Specifically, the controller 11 functions as the application controller 140 and, in cases in which the ink is being applied, stops that application processing. Moreover, in this case, the controller 11 does not cause the applicator 19 to apply the ink even if the movement detector 16 newly detects movement of the applicator device 10.

If the application of the ink is stopped, the controller 11 functions as the notifier 130 and issues a notification that the contact of the applicator device 10 against the application target 30 is excessively weak (step S5). Specifically, the controller 11 outputs, via the display or the speaker of the user interface 13, a message such as "The pressure of the device is insufficient. Please apply more pressure."

In step S1, when at least one of the measured values of the pressure from the two pressure sensors 25*a* and 25*b* is greater than the maximum value TH (step S1; measured value>TH), there is a high possibility that the contact of the applicator device 10 against the application surface 31 is excessively strong and that the applicator device 10 is sunk into the application surface 31, as illustrated in FIG. 7. As such, in this case, the controller 11 stops the application of the ink (step S6). Specifically, the controller 11 functions as the application controller 140 and, in cases in which the ink is being applied, stops that application processing. Moreover, in this case, the controller 11 does not cause the applicator 19 to apply the ink even if the movement detector 16 newly detects movement of the applicator device 10.

If the application of the ink is stopped, the controller 11 functions as the notifier 130 and issues a notification that the contact of the applicator device 10 against the application target 30 is excessively strong (step S7). Specifically, the controller 11 outputs, via the display or the speaker of the user interface 13, a message such as "The device is applying too much pressure. Please apply less pressure."

The controller 11 returns to the processing of step S1 after notifying that the contact is excessively weak in step S5 or after notifying that the contact is excessively strong in step S7. Then, the controller 11 determines again whether the measured values of the pressure from the two pressure sensors 25*a* and 25*b* are within the predetermined range. When, it is determined that the measured values of the pressure are not within the predetermined range, the controller 11 executes the processing of steps S4 and S5 or the processing of steps S6 and S7. In contrast, when it is determined that the measured values of the pressure are within the predetermined range, the controller 11 executes the processing of steps S2 and S3 and applies the ink to the application target 30 in response to the movement of the applicator device 10. Finally, if the application of the ink is completed (step S3; YES), the controller 11 ends the application processing illustrated in FIG. 10.

As described above, the applicator device 10 according to Embodiment 1 acquires, as index values representing the strength of contact of the applicator device 10 against the application target 30, the values of the pressure measured by the pressure sensors 25*a* and 25*b*. Moreover, when the acquired values of the pressure are within the predetermined range, the applicator device 10 according to Embodiment 1 applies, based on the movement of the applicator device 10 detected by the movement detector 16, the ink to the application target 30. Thus, applying mistakes caused by the contact of the applicator device 10 against the application target 30 being excessively strong or excessively weak can be suppressed. As a result, the manual scanning-type applicator device 10 can appropriately apply the ink to the application surface 31.

When, particularly, the application surface 31 is skin, rubber, or a similar material that has elasticity, the applicator device 10 will sink into the application surface 31 if the contact of the applicator device 10 against the application target 30 is excessively strong. As a result, the tips of the nozzles will contact the application surface 31, thereby obstructing the appropriate discharge of the ink from the nozzles. When the values of the pressure measured by the pressure sensors 25*a* and 25*b* are greater than the maximum value TH, the applicator device 10 according to Embodiment 1 does not apply the ink even if movement of the applicator device 10 is detected, and the notifier 130 issues an alert. Due to this configuration, it is possible to prevent the applicator device 10 from sinking into the application surface 31 when the application surface 31 has elasticity, thereby making it possible to appropriately apply the ink.

Embodiment 2

Next, Embodiment 2 of the present disclosure will be described. In Embodiment 2, as appropriate, descriptions of configurations and functions that are the same as described in Embodiment 1 are forgone.

In Embodiment 1, the acquirer 110 acquires, as index values representing the strength of contact of the applicator device 10 against the application target 30, the values of the pressure measured by the pressure sensors 25*a* and 25*b*. In contrast, in Embodiment 2, instead of the values of the pressure measured by the pressure sensors 25*a* and 25*b*, the acquirer 110 acquires, as index values representing the strength of contact, a value of capacitance measured by a capacitance sensor 26 and a value of distance measured by a distance sensor 27. Note that the capacitance used as the index value is a physical quantity measured in terms of Farads, and the distance used as the index value is a physical quantity measured in terms of meters.

Figure 11:
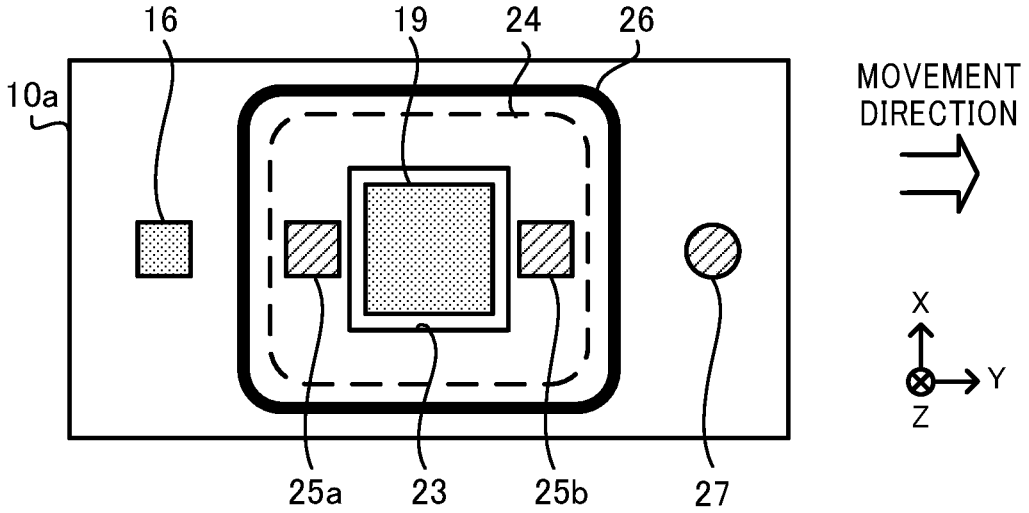
FIG. 11 is a drawing schematically illustrating the bottom surface of an applicator device according to Embodiment 2 of the present disclosure.
Figure 12:
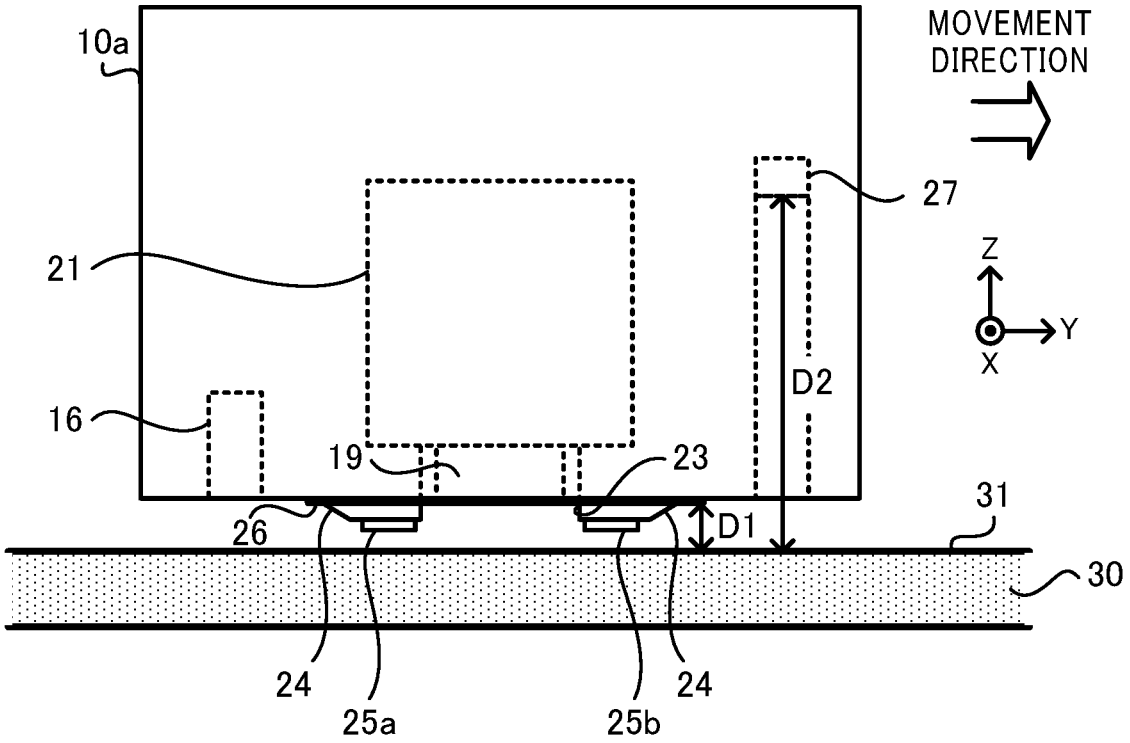
FIG. 12 is a drawing illustrating the applicator device according to Embodiment 2, as seen from the side.

FIG. 11 illustrates the bottom surface of an applicator device 10*a* according to Embodiment 2. FIG. 12 illustrates the applicator device 10*a* according to Embodiment 2 from the side. As illustrated in FIGS. 11 and 12, the applicator device 10*a* according to Embodiment 2 includes a capacitance sensor 26 and a distance sensor 27 in addition to the two pressure sensors 25*a* and 25*b*.

The capacitance sensor 26 measures the capacitance generated between the applicator device 10*a* and the application target 30 when the applicator device 10*a* is placed on the application target 30. When the capacitance sensor 26 is brought into proximity with the application target 30, the capacitance sensor 26 detects the capacitance generated in the space of the distance D1 between the capacitance sensor 26 and the application surface 31, and converts the detected capacitance to an electronic signal. As a result, the capacitance sensor 26 measures the capacitance generated between the capacitance sensor 26 and the application target 30 without contacting the application target 30. The capacitance sensor 26 functions as second measuring means that measures an index value that represents the strength of contact of the applicator device 10*a* against the application target 30.

As illustrated in FIGS. 11 and 12, the capacitance sensor 26 has a ring shape similar to a rectangle, and is provided along the periphery of the application opening 23 for the ink of the applicator 19 so as to surround the application opening 23. Since the capacitance sensor 26 is provided on the periphery of the application opening 23, the capacitance sensor 26 can accurately measure the capacitance generated near the application opening 23.

The capacitance sensor 26 is not provided on the protrusion 24. Specifically, the capacitance sensor 26 is provided at a position around the protrusion 24 where the height is less than that of the protrusion 24. Due to this configuration, when the applicator device 10*a* is placed such that the protrusion 24 contacts the application surface 31, the capacitance sensor 26 will be near the application surface 31 but will not contact the application surface 31. In this state, the capacitance sensor 26 measures the capacitance generated between the capacitance sensor 26 and the application surface 31.

The distance sensor 27 is disposed inside the housing of the applicator device 10*a* so as to face the lower side of the applicator device 10. The distance sensor 27 measures a distance D2 to the application target 30 when the applicator device 10*a* is placed on the application target 30. In one example, the distance sensor 27 includes a light emitter that emits infrared light, and a light receiver that receives the infrared light, emitted from the light emitter, that reflects at the application surface 31. Here, the distance sensor 27 measures, without contacting the application surface 31, the distance to the application surface 31 based on the reflected light received by the receiver. Note that the distance sensor 27 is not limited to types that utilize the reflection of infrared light, and the distance to the application target 30 may be measured by any method. The distance sensor 27 functions as third measuring means that measures an index value that represents the strength of contact of the applicator device 10*a* against the application target 30.

The acquirer 110 acquires, as index values representing the strength of contact of the applicator device 10*a* against the application target 30, the values of the pressure measured by the two pressure sensors 25*a* and 25*b*, the value of the capacitance measured by the capacitance sensor 26, and the value of the distance measured by the distance sensor 27. If the strength of contact of the applicator device 10*a* against the application target 30 increases, the distance D1 between the applicator device 10 and the application surface 31 will decrease, and the capacitance will increase. As such, the value of the capacitance measured by the capacitance sensor 26 is an index value that, similar to the pressure, increases as the strength of contact increases. In contrast, the value of the distance D2 measured by the distance sensor 27 is an index value that decreases as the strength of contact increases.

The determiner 120 determines whether each of the two values of the pressure, the value of the capacitance, and the value of the distance acquired by the acquirer 110 as the index values are within predetermined ranges. Specifically, the determiner 120 compares each of the values of the pressure measured by the two pressure sensors 25*a* and 25*b* with the maximum value TH and the minimum value TL, compares the value of the capacitance measured by the capacitance sensor 26 with a maximum value TL2 and a minimum value TL2, and compares the value of the distance measured by the distance sensor 27 with a maximum value TH3 and a minimum value TL3. Here, the maximum value TH2 and the minimum value TL2 are thresholds that are set for determining whether the measured value of the capacitance by the capacitance sensor 26 is within the predetermined range. The maximum value TH3 and the minimum value TL3 are thresholds that are set for determining whether the measured value of the distance by the distance sensor 27 is within the predetermined range. Note that the predetermined ranges are determined based on various factors such as the weight of the applicator device 10*a*, the positions where the pressure sensors are installed on the applicator device 10*a*, and the like. As such, the predetermined ranges can be set at the design stage or prior to use.

Cases in which the value of the capacitance measured by the capacitance sensor 26 is greater than the maximum value TH2, and cases in which the value of the distance measured by the distance sensor 27 is less than the minimum value TL3 correspond to cases in which the pressure applied to the application surface 31 by the applicator device 10*a* is excessively strong. Therefore, in such cases, the determiner 120 determines that the applicator device 10*a* is sunk into the application surface 31 and, as such, application is not possible.

In contrast, cases in which the value of the capacitance measured by the capacitance sensor 26 is less than the minimum value TL2, and cases in which the value of the distance measured by the distance sensor 27 is greater than the maximum value TH3 correspond to cases in which the pressure applied to the application surface 31 by the applicator device 10*a* is excessively weak. As such, in these cases, the determiner 120 determines that the applicator device 10*a* is not in correct contact with the application surface 31 and, as such, application is not possible.

However, the determiner 120 determines that the ink can be appropriately applied in cases in which both of the values of the pressure measured by the two pressure sensors 25*a* and 25*b* are less than or equal to the maximum value TH and greater than or equal to the minimum value TL, the value of the capacitance measured by the capacitance sensor 26 is less than or equal to the maximum value TH2 and greater than or equal to the minimum value TL2, and the value of the distance measured by the distance sensor 27 is less than or equal to the maximum value TH3 and greater than or equal to the minimum value TL3.

The notifier 130 and the application controller 140 execute the same processing as described in Embodiment 1 in accordance with the determination results by the determiner 120. Specifically, the notifier 130 issues an alert when one or more of the two measured values of the pressure, the measured value of the capacitance, and the measured value of the distance is not within the respective predetermined range. Moreover, when one or more of the two measured values of the pressure, the measured value of the capacitance, and the measured value of the distance is not within the respective predetermined range, the application controller 140 does not cause the applicator 19 to apply the ink even if the movement detector 16 detects movement of the applicator device 10*a*. In contrast, when all of the two measured values of the pressure, the measured value of the capacitance, and the measured value of the distance are within the respective predetermined ranges, the application controller 140 causes the applicator 19 to apply the ink based on the movement of the applicator device 10*a* detected by the movement detector 16.

As described above, the applicator device 10*a* according to Embodiment 2 includes the two pressure sensors 25*a* and 25*b*, the capacitance sensor 26, and the distance sensor 27. Additionally, when all of the measured values from the various sensors are within the respective predetermined ranges, the applicator device 10*a* applies the ink to the application target 30 based on the movement of the applicator device 10*a* detected by the movement detector 16. Since a plurality of types of sensors are provided, the applicator device 10*a* can more accurately determine whether the applicator device 10*a* is correctly placed on the application surface 31. As a result, applying mistakes caused by the contact of the applicator device 10*a* against the application target 30 being excessively strong or excessively weak can be suppressed, and the ink can be appropriately applied to the application surface 31.

MODIFIED EXAMPLES

Embodiments of the present disclosure are described above, but these embodiments are merely examples and do not limit the scope of application of the present disclosure. That is, various applications of the embodiments of the present disclosure are possible, and all embodiments are included in the scope of the present disclosure.

For example, in the embodiments described above, the applicator devices 10 and 10*a* include the two pressure sensors 25*a* and 25*b*. However, a configuration is possible in which the applicator device 10 or 10*a* includes three or more pressure sensors. When the applicator device 10 or 10*a* includes three or more pressure sensors, it is preferable that the pressure sensors are disposed on the protrusion 24 on the periphery of the application opening 23 provided in the bottom surface of the applicator device 10 or 10*a*. It is also preferable that the pressure sensors are disposed at symmetrical positions around the application opening 23 such that the spacing therebetween is equal. As a result of including multiple pressure sensors, whether the applicator device 10 or 10*a* is correctly set on the application target 30 can be determined with greater accuracy.

Configurations are possible in which the applicator device 10 or 10*a* includes only one pressure sensor, the applicator device 10 or 10*a* includes only one capacitance sensor 26, and the applicator device 10 or 10*a* includes only one distance sensor 27. Provided that at least one of these three types of sensors is included, the applicator device 10 or 10*a* can acquire the minimum required index values that represent the strength of contact of the applicator device 10 or 10*a* against the application target 30.

In the embodiments described above, the predetermined ranges used in the determination by the determiner 120 are the ranges less than or equal to the maximum values TH, TH2, and TH3 and greater than or equal to the minimum values TL, TL2, and TL3. However, a configuration is possible in which the predetermined ranges are defined by only one of the maximum values TH, TH2, and TH3 and the minimum values TL, TL2, and TL3. Even when using only one of the maximum values TH, TH2, and TH3 and the minimum values TL, TL2, and TL3, it is still possible to prevent the strength of contact of the applicator device 10 against the application target 30 from becoming excessively strong or from becoming excessively weak. As such, the manual scanning-type applicator device 10 or 10*a* can appropriately apply the ink to the application surface 31.

In the embodiments described above, the applicator device 10 or 10*a* is a device that prints a designated image such as "ABC" by applying ink to the application target 30 based on movement of the applicator device 10 or 10*a* on the application target 30. However, the applicator device 10 or 10*a* is not limited to printing such images and a configuration is possible in which the applicator device 10 or 10*a* is a device that forms a pattern such as a figure or a design on the application surface 31 of the application target 30 by applying ink or is a device that applies a desired color on the application surface 31. Moreover, a configuration is possible in which the applicator device 10 or 10*a* applies ink over dirt, stains, or the like that are present on the application target 30, thereby covering and hiding the dirt, stains, or the like with ink of a desired color.

In the embodiments described above, the applicator device 10 or 10*a* prints a character string such as "ABC" on the application target 30 by applying the ink in accordance with the application data that is specified by the user. However, a configuration is possible in which the applicator device 10 or 10*a* includes an imaging device that images the application surface 31 of the application target 30, and the applicator device 10 or 10*a* applies the ink based on an image of the application surface 31 that is captured by the imaging device. Here, the imaging device is a so-called camera. When the applicator device 10 or 10*a* has moved on the application target 30, the imaging device images the region where the ink is to be applied on the application target 30. The imaging by the imaging device is performed prior to the application of the ink by the applicator 19. The application controller 140 determines the application pattern of the ink based on the captured image obtained by the imaging device, and causes the applicator 19 to apply the ink in the determined application pattern.

In one example, the application controller 140 determines, from the captured image, a portion where characters or the like already exist on the application surface 31. Under the control of the application controller 140, the applicator 19 may apply ink to the portion of the application surface 31 where the characters or the like already exist, thereby changing the color or density of the characters or the like, or may apply ink to the peripheral portion of the characters or the like, thereby bordering the characters or the like. Alternatively, a configuration is possible in which the applicator 19 applies ink to the background portion of the application surface 31, thereby printing a background image. Here, the background portion is a portion of the application surface 31 where no characters or the like are present.

In the embodiments described above, the applicator device 10 or 10*a* applies the ink to the application surface 31 when the applicator device 10 or 10*a* moves on the application target 30 in a predetermined direction (the +Y-direction). However, the applicator device 10 or 10*a* is not limited to applying the ink when moving in one direction on the application surface 31, and a configuration is possible in which the applicator device 10 or 10*a* applies the ink based on movement of the applicator device 10 or 10*a* in any direction, including the −Y-direction and the ±X-directions, on the application surface 31 (the XY plane). In other words, a configuration is possible in which the applicator device 10 or 10*a* is capable of applying the ink in any region of the application target 30 while the user scans the applicator device 10 or 10*a* in any direction on the application surface 31.

In the embodiments described above, the applicator 19 discharges the ink from the applicator 19 by a thermal method. However, the method whereby the applicator 19 discharges the ink is not limited and a different method may be used. For example, a configuration is possible in which the applicator 19 discharges the ink using a Piezo method. In such a method, piezo elements are used to print the image to be printed on the application target 30. Moreover, the method whereby the applicator 19 applies the ink onto the application target 30 is not limited to an ink jet method and a different method, such as a thermal transfer method, may be used. Additionally, the shape of the applicator device 10 or 10*a* is not limited to the square columnar shape illustrated in FIG. 1, and any shape may be used.

In the embodiments described above, in the controller 11, the processor (the CPU) 11*a* executes the program stored in the ROM 11*b*, thereby functioning as the various components, namely the acquirer 110, the determiner 120, the notifier 130, and the application controller 140. However, the controller 11 may include, for example, an Application Specific Integrated Circuit (ASIC), a Field-Programmable Gate Array (FPGA), various control circuitry, or other dedicated hardware, and this dedicated hardware may function as the various components, namely the acquirer 110, the determiner 120, the notifier 130, and the application controller 140.

In this case, the functions of each of the components may be realized by individual pieces of hardware, or the functions of each of the components may be collectively realized by a single piece of hardware. Additionally, the functions of each of the components may be realized in part by dedicated hardware and in part by software or firmware. Note that, the constituents that execute the various functions, including these dedicated pieces of hardware and the CPU, can be collectively referred to as a processor.

It is possible to provide an applicator device that is provided in advance with the configurations for realizing the functions according to the present disclosure, and it is also possible to apply a program to cause an existing information processing device or the like to function as the applicator device according to the present disclosure. That is, a configuration is possible in which a CPU or the like that controls an existing information processing apparatus or the like is used to execute a program for realizing the various functional components of the applicator device 10 or 10*a* described in the foregoing embodiments, thereby causing the existing information processing device to function as the applicator device according to the present disclosure. Additionally, an application method according to the present disclosure can be implemented using the applicator device.

Any method may be used to apply the program. For example, the program can be applied by storing the program on a non-transitory computer-readable recording medium such as a flexible disc, a compact disc (CD) ROM, a digital versatile disc (DVD) ROM, and a memory card.
Furthermore, the program can be superimposed on a carrier wave and applied via a communication medium such as the internet. For example, the program may be posted to and distributed via a bulletin board system (BBS) on a communication network. Moreover, a configuration is possible in which the processing described above is executed by starting the program and, under the control of the operating system (OS), executing the program in the same manner as other applications/programs.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. An applicator device comprising:

a print head that applies a droplet to a target;

a protrusion that is provided on a surface opposing to the target and protrudes toward the target;

a pressure sensor that is provided on the protrusion and measures pressure applied by the applicator device to the target when the applicator device is placed in contact with the target;

a capacitance sensor that is provided at a position around the protrusion and measures capacitance generated between the applicator device and the target when the applicator device is placed in contact with the target; and a processor configured to acquire a value indicating the pressure measured by the pressure sensor and a value indicating the capacitance measured by the capacitance sensor, detect movement of the applicator device on the target, and control, when the acquired value indicating the pressure is within a range that is set for the value indicating the pressure and the acquired value indicating the capacitance is within a range that is set for the value indicating the capacitance, the print head to apply the droplet on the target based on the detected movement.

2. The applicator device according to claim 1, wherein the processor is configured to control, when the acquired value indicating the pressure is not within the range that is set for the value indicating the pressure or when the acquired value indicating the capacitance is not within the range that is set for the value indicating the capacitance, the print head not to apply the droplet to the target in a case where the movement is detected.

3. The applicator device according to claim 1, wherein the processor executes a process of issuing an alert when the acquired value indicating the pressure is not within the range that is set for the value indicating the pressure or when the acquired value indicating the capacitance is not within the range that is set for the value indicating the capacitance.

4. The applicator device according to claim 1, wherein:

each of the range that is set for the value indicating the pressure and the range that is set for the value indicating the capacitance is a range that is less than or equal to a predetermined maximum value and also greater than or equal to a predetermined minimum value, and the maximum value and the minimum value of the range that is set for the value indicating the pressure are respectively different from the maximum value and the minimum value of the range that is set for the value indicating the capacitance.

5. The applicator device according to claim 1, wherein the pressure sensor is disposed on a periphery of an opening for the droplet of the print head, the opening being provided in the applicator device.

6. The applicator device according to claim 1, wherein:

the pressure sensor includes a first pressure sensor and a second pressure sensor that measure pressure applied by the applicator device to the target when the applicator device is placed in contact with the target, the first pressure sensor and the second pressure sensor are provided on the protrusion and at positions symmetrical around the opening for the droplet of the print head, and the processor is configured to acquire, as the value indicating the pressure applied to the target, values of the pressure measured by the first pressure sensor and the second pressure sensor, and control, when all of the values of the pressure are within the range that is set for the value indicating the pressure, the print head to apply the droplet on the target based on the movement.

7. The applicator device according to claim 1, wherein the capacitance sensor is provided along a periphery of the opening for the droplet of the print head.

8. The applicator device according to claim 1, further comprising:

a distance sensor that measures a distance from the applicator device to the target, wherein the processor is configured to acquire a value indicating the distance measured by the distance sensor, and control, when the acquired value indicating the pressure is within the range that is set for the value indicating the pressure, the acquired value indicating the capacitance is within the range that is set for the value indicating the capacitance, and the acquired value indicating the distance is within a range that is set for the value indicating the distance, the print head to apply the droplet on the target based on the detected movement.

9. The applicator device according to claim 1, wherein the target has elasticity.

10. An application method for applying a droplet using an applicator device comprising a protrusion that is provided in a surface opposing to a target and protrudes toward the target:

the method comprising:

acquiring, by a pressure sensor that is provided on the protrusion, a value indicating pressure applied by the applicator device to the target when the applicator device is placed in contact with the target;

acquiring, by a capacitance sensor that is provided at a position around the protrusion, a value indicating capacitance generated between the applicator device and the target when the applicator device is placed in contact with the target;

detecting movement of the applicator device on the target; and applying the droplet on the target based on the detected movement when the acquired value indicating the pressure is within a range that is set for the value indicating the pressure and the acquired value indicating the capacitance is within a range that is set for the value indicating the capacitance.

11. A non-transitory computer-readable recording medium that stores a program that causes a computer of an applicator device comprising a protrusion that is provided in a surface opposing to a target and protrudes toward the target to:

acquire, by a pressure sensor that is provided on the protrusion, a value indicating pressure applied by the applicator device to the target when the applicator device is placed in contact with the target;

acquire, by a capacitance sensor that is provided at a position around the protrusion, a value indicating capacitance generated between the applicator device and the target when the applicator device is placed in contact with the target;

detect movement of the applicator device on the target; and apply a droplet on the target based on the detected movement when the acquired value indicating the pressure is within a range that is set for the value indicating the pressure and the acquired value indicating the capacitance is within a range that is set for the value indicating the capacitance.

* * * * *